US011798466B2

(12) United States Patent
Lee

(10) Patent No.: US 11,798,466 B2
(45) Date of Patent: Oct. 24, 2023

(54) DATA DRIVING UNIT AND DISPLAY DEVICE INCLUDING THE SAME

(71) Applicant: LG Display Co., Ltd., Seoul (KR)

(72) Inventor: Won Suk Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/954,062

(22) Filed: Sep. 27, 2022

(65) Prior Publication Data

US 2023/0196980 A1 Jun. 22, 2023

(30) Foreign Application Priority Data

Dec. 22, 2021 (KR) ..... 10-2021-0185127

(51) Int. Cl.
*G09G 3/36* (2006.01)
*G09G 3/32* (2016.01)

(52) U.S. Cl.
CPC ..... *G09G 3/32* (2013.01); *G09G 2310/027* (2013.01); *G09G 2310/0278* (2013.01); *G09G 2310/0291* (2013.01)

(58) Field of Classification Search
CPC ..... G09G 3/32; G09G 2310/027; G09G 2310/0278; G09G 2310/0291; G09G 3/3677; G09G 5/10; G09G 3/3688
USPC ..... 345/204
See application file for complete search history.

(56) References Cited

U.S. PATENT DOCUMENTS

2009/0058838 A1* 3/2009 Lee ..... G09G 3/3688 345/204
2017/0323611 A1* 11/2017 Jo ..... G09G 3/3677
2021/0217382 A1* 7/2021 Horibe ..... G09G 5/10

* cited by examiner

*Primary Examiner* — Abdul-Samad A Adediran
(74) *Attorney, Agent, or Firm* — Birch, Stewart, Kolasch & Birch, LLP

(57) ABSTRACT

A display device can include a display panel configured to display an image, a scan driving circuit configured to supply a scan signal to the display panel, and a data driving circuit configured to supply a data voltage to the display panel. The data driving circuit can include a data controller configured to vary an output timing of the data voltage based on independent control for each of at least one latch.

14 Claims, 10 Drawing Sheets

DATA DRIVING UNIT AND DISPLAY DEVICE INCLUDING THE SAME

CROSS-REFERENCE TO RELATED APPLICATION

This application claims the priority benefit of Korean Patent Application No. 10-2021-0185127, filed in the Republic of Korea on Dec. 22, 2021, the entire contents of which are hereby expressly incorporated by reference into the present application.

BACKGROUND OF THE DISCLOSURE

Technical Field

The present disclosure relates to a data driving circuit and a display device including the same.

Discussion of the Related Art

With the development of information technology, the market for display devices, which are connection media between users and information, has been growing. Accordingly, there has been an increase in use of display devices such as a light-emitting display device (LED), a quantum dot display device (QDD), and a liquid crystal display device (LCD).

The display devices described above each include a display panel including subpixels, a driving unit configured to output a driving signal for driving the display panel, a power supply unit configured to generate power to be supplied to the display panel or the driving unit, etc.

In each of the display devices, when a driving signal, for example, a scan signal, a data signal, etc. is supplied to the subpixels formed in the display panel, an image can be displayed by a selected subpixel transmitting light or directly emitting light.

SUMMARY OF THE DISCLOSURE

Accordingly, the present disclosure is directed to a data driving unit and a display device including the same that substantially obviate one or more problems due to limitations and disadvantages of the related art.

An object of the present disclosure is to prevent or relieve a display defect (so-called color mixing) which can be caused by latency of a scan signal, by varying the output timing of a data voltage based on independent control for each of at least one latch, thereby increasing effectiveness during high-speed driving.

Additional advantages, objects, and features of the present disclosure will be set forth in part in the description which follows and in part will become apparent to those having ordinary skill in the art upon examination of the following or can be learned from practice of the present disclosure. The objectives and other advantages of the present disclosure can be realized and attained by the structure particularly pointed out in the written description and claims hereof as well as the appended drawings.

To achieve these objects and other advantages and in accordance with the purpose of the present disclosure, as embodied and broadly described herein, a display device can include a display panel configured to display an image, a scan driving circuit configured to supply a scan signal to the display panel, and a data driving circuit configured to supply a data voltage to the display panel, in which the data driving circuit can include a data controller configured to vary an output timing of the data voltage based on independent control for each of at least one latch.

The data controller can independently control a sampling time or a holding time of each of data signals by controlling latch enable signals applied to latches to vary output timing of the data voltage.

The latches included in the data driving circuit can store the data signals at the same time, and output timing can be different for each of at least one latch in response to the latch enable signal.

The latches included in the data driving circuit can include a latch for outputting one of the data signals first and a latch for outputting one of the data signals last, and the output timings of outputting the data signals can be gradually varied for latches located therebetween.

The data driving circuit can be controlled so that the output timing of the data voltage is gradually delayed from a first side part (e.g., right side part) toward a central part of the display panel, and the output timing of the data voltage is gradually delayed from a second side part (e.g., left side part) toward the central part of the display panel.

The data driving circuit can output the data voltage first in the left side part and the right side part of the display panel, and output the data voltage last in the central part of the display panel.

The data controller can include a plurality of delays configured to delay the latch enable signal, and each of the plurality of delays can add a delay value to an undelayed latch enable signal to output a delayed latch enable signal.

In another aspect of the present disclosure, a data driving circuit includes a plurality of latches configured to store data signals, a plurality of digital-to-analog converters configured to convert the data signals output from the plurality of latches into data voltages, a plurality of output circuits configured to amplify and output the data voltages output from the digital-to-analog converters, and a data controller configured to control the plurality of latches so that output timings of the data voltages are varied for each of at least one channel.

The plurality of latches can store the data signals at the same time, and output timing can be different for each of at least one latch in response to latch enable signals.

The plurality of latches can include a latch outputting one of the data signals first and a latch outputting one of the data signals last, and output timings of outputting the data signals can be gradually varied for latches located therebetween.

It is to be understood that both the foregoing general description and the following detailed description of the present disclosure are exemplary and explanatory and are intended to provide further explanation of the present disclosure as claimed.

BRIEF DESCRIPTION OF THE DRAWINGS

The accompanying drawings, which are included to provide a further understanding of the present disclosure and are incorporated in and constitute a part of this application, illustrate embodiment(s) of the present disclosure and together with the description serve to explain the principle of the present disclosure. In the drawings.

DETAILED DESCRIPTION OF THE EMBODIMENTS

Reference will now be made in detail to the preferred embodiments of the present disclosure, examples of which are illustrated in the accompanying drawings. Wherever possible, the same reference numbers will be used throughout the drawings to refer to the same or like parts.

A display device according to one or more embodiments of the present disclosure can be implemented as a television, a video player, a personal computer (PC), a home theater, an automobile electric device, a smartphone, etc., but is not limited thereto. The display device according to one or more embodiments of the present disclosure can be implemented as an LED, a QDD, an LCD, etc. However, hereinafter, for convenience of description, a light-emitting display device that directly emits light based on an inorganic light-emitting diode or an organic light-emitting diode will be given as an example.

Figure 1:
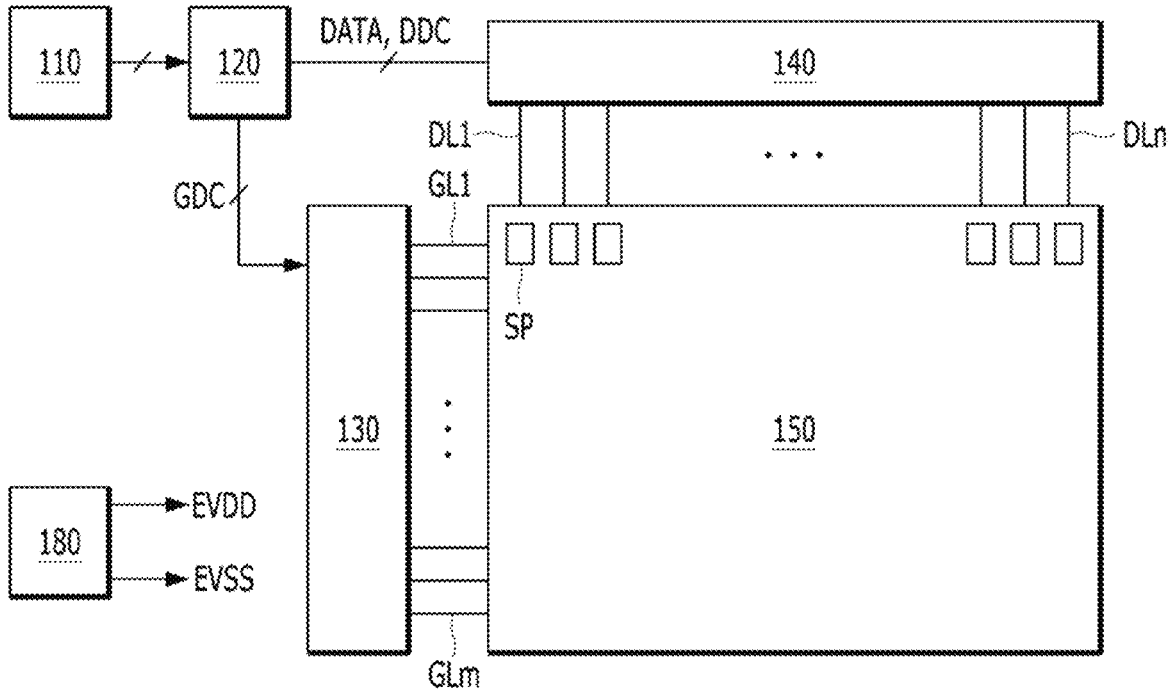
FIG. 1 is a block diagram schematically illustrating a light-emitting display device according to an embodiment of the present disclosure.
Figure 2:
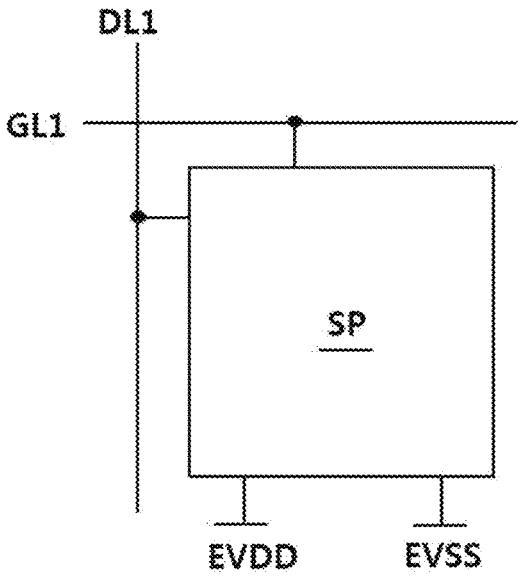
FIG. 2 is a configuration diagram schematically illustrating a subpixel illustrated in FIG. 1.

FIG. 1 is a configuration diagram schematically illustrating a light-emitting display device according to an embodiment of the present disclosure, and FIG. 2 is a block diagram schematically illustrating a subpixel illustrated in FIG. 1.

As illustrated in FIGS. 1 and 2, the light-emitting display device can include an image supply unit (circuit) 110, a timing controller 120, a scan driving unit (circuit) 130, a data driving unit (circuit) 140, a display panel 150, a power supply unit (circuit) 180, etc.

The image supply unit (set or host system) 110 can output various driving signals along with an image data signal supplied from the outside or an image data signal stored in an internal memory. The image supply unit 110 can supply a data signal and various driving signals to the timing controller 120.

The timing controller 120 can output a gate timing control signal GDC for controlling the operation timing of the scan driving unit 130, a data timing control signal DDC for controlling the operation timing of the data driving unit 140, various synchronization signals (Vsync, which is a vertical synchronization signal, and Hsync, which is a horizontal synchronization signal), etc. The timing controller 120 can supply a data signal DATA supplied from the image supply unit 110 together with the data timing control signal DDC to the data driving unit 140. The timing controller 120 can be formed as an integrated circuit (IC) and mounted on a printed circuit board, but is not limited thereto.

The scan driving unit 130 can output a scan signal (or a scan voltage) in response to the gate timing control signal GDC supplied from the timing controller 120. The scan driving unit 130 can supply a scan signal to subpixels included in the display panel 150 through gate lines GL1 to GLm. The scan driving unit 130 can be formed as an IC or can be formed directly on the display panel 150 in a GIP method, but is not limited thereto.

The data driving unit 140 can sample and latch the data signal DATA in response to the data timing control signal DDC supplied from the timing controller 120, convert a digital data signal into an analog data voltage based on a gamma reference voltage, and output the analog data voltage. The data driving unit 140 can supply a data voltage to the subpixels included in the display panel 150 through data lines DL1 to DLn. The data driving unit 140 can be formed as an IC and mounted on the display panel 150 or mounted on a printed circuit board, but is not limited thereto.

The power supply unit 180 can generate first power having a high potential and second power having a low potential based on an external input voltage supplied from the outside, and output the first power and the second power through a first power line EVDD and a second power line EVSS. The power supply unit 180 can generate and output a voltage necessary to drive the scan driving unit 130 (for example, a gate voltage including a gate high voltage and a gate low voltage) or a voltage necessary to drive the data driving unit 140 (a drain voltage including a drain voltage and a half-drain voltage) in addition to the first power and the second power.

The display panel 150 can display an image in response to a driving signal including a scan signal and a data voltage, first power, second power, etc. The subpixels of the display panel 150 directly emit light. The display panel 150 can be manufactured based on a substrate having rigidity or flexibility, such as glass, silicon, polyimide, etc. In addition, the subpixels that emit light can include pixels including red, green, and blue or pixels including red, green, blue, and white. But the present disclosure is not limited thereto. For example, color combinations such as yellow, magenta, cyan are also possible.

For example, each of one or more subpixels SP can be connected to the first data line DL1, the first gate line GL1, the first power line EVDD, and the second power line EVSS, and can include a pixel circuit having a switching transistor, a driving transistor, a capacitor, an organic light-emitting diode (OLED), etc. Since the subpixel SP used in the light-emitting display device directly emits light, a circuit configuration is complicated. In addition, there are various compensation circuits for compensating for deterioration of the OLED that emits light as well as the driving transistor that supplies a driving current used to drive the OLED. Accordingly, note that the subpixel SP is simply illustrated in the form of a block.

Meanwhile, in the above description, the timing controller 120, the scan driving unit 130, the data driving unit 140, etc. have been described as individual elements. However, depending on the implementation method of the light-emitting display device, one or more of the timing controller 120, the scan driving unit 130, and the data driving unit 140 can be integrated into one IC.

Figure 3:
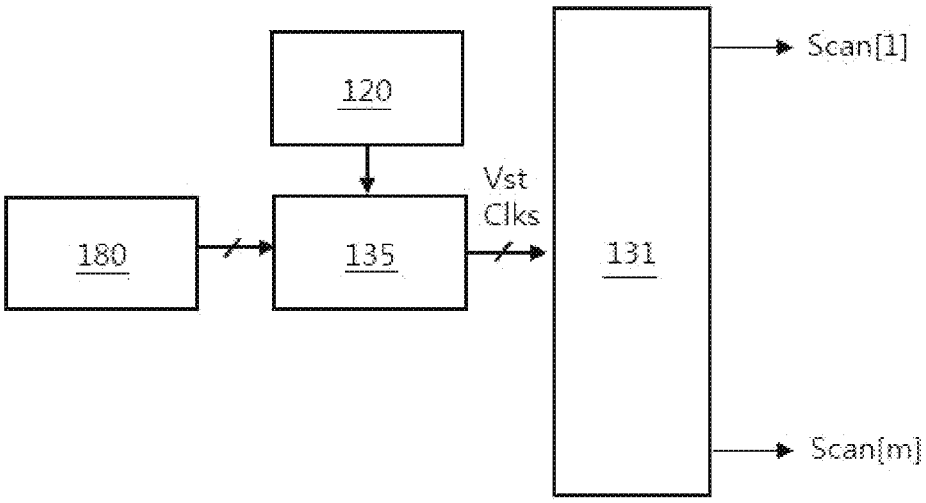
FIGS. 3 and 4 are diagrams for describing a configuration of a gate-in-panel (GIP) type scan driving unit according to an embodiment of the present disclosure.
Figure 4:
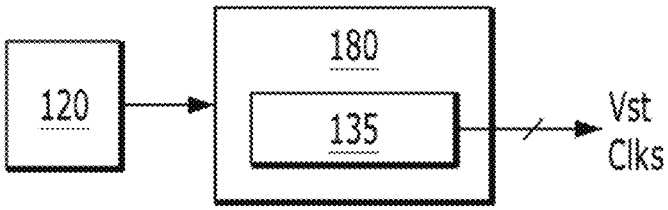
Figure 5A:
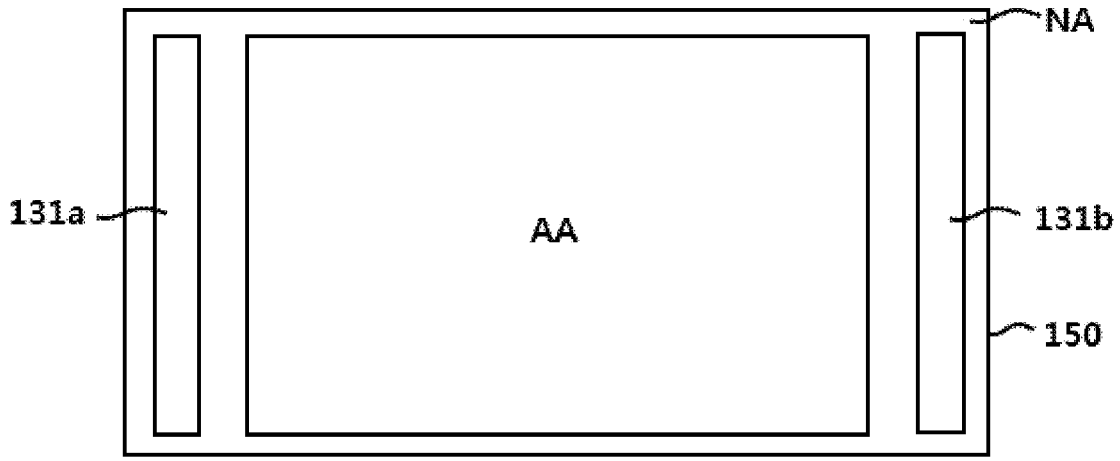
FIGS. 5A and 5B are diagrams illustrating arrangement examples of the GIP type scan driving unit.
Figure 5B:
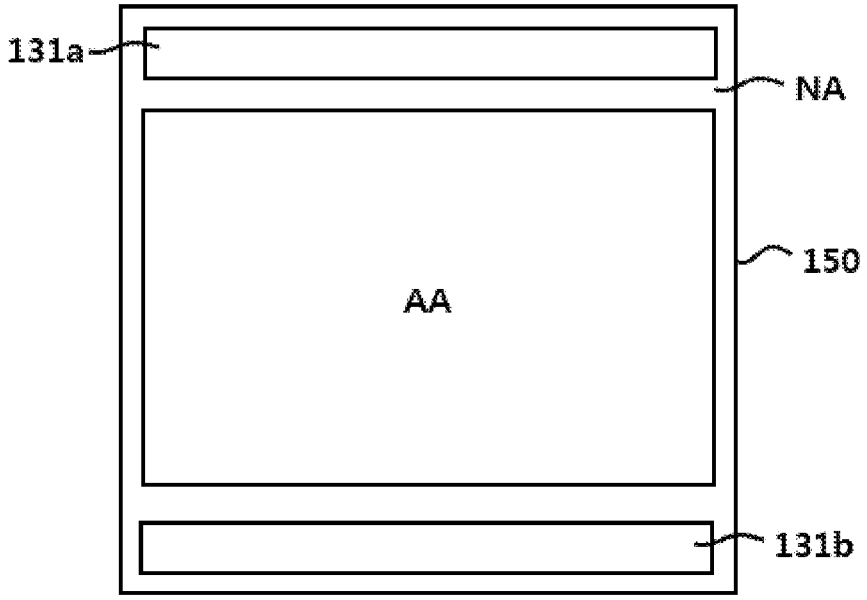
Figure 6:
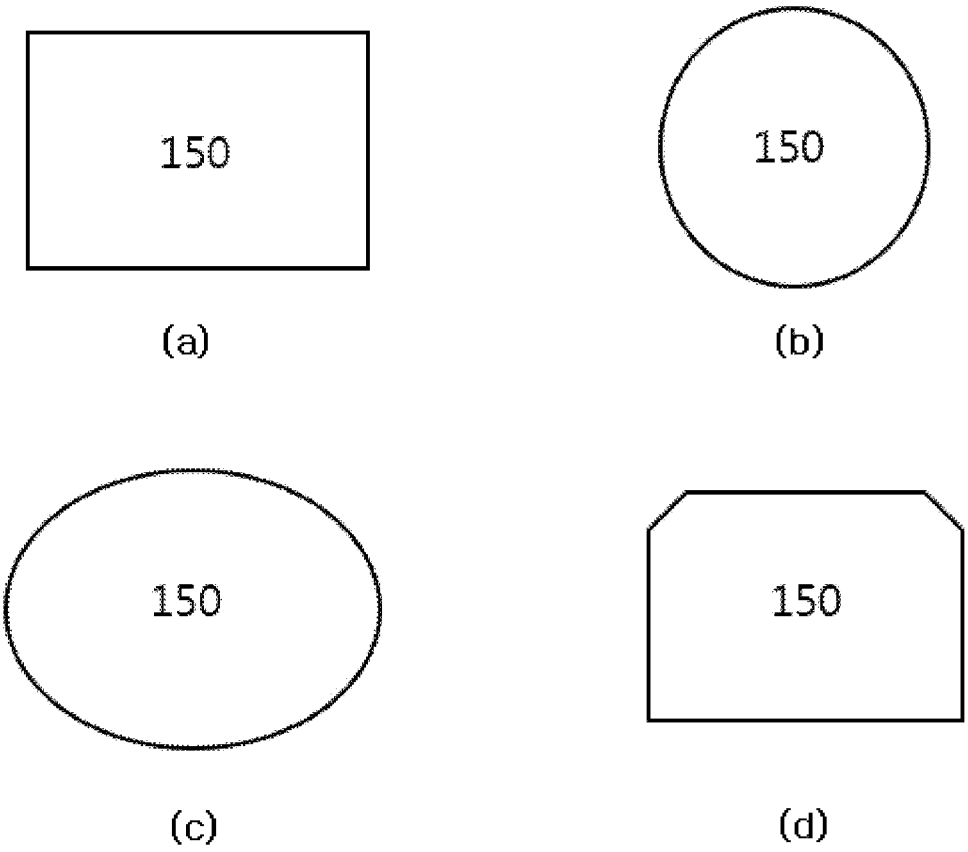
FIG. 6 shows diagrams illustrating examples of a shape of a display panel according to an embodiment of the present disclosure.

FIGS. 3 and 4 are diagrams for describing a configuration of a GIP type scan driving unit according to an embodiment of the present disclosure, FIGS. 5A and 5B are diagrams illustrating arrangement examples of the GIP type scan driving unit, and FIG. 6 shows diagrams illustrating examples of a shape of a display panel according to an embodiment of the present disclosure.

As illustrated in FIG. 3, the GIP type scan driving unit 130 can include a shift register 131 and a level shifter 135. The level shifter 135 can generate driving clock signals Clks and a start signal Vst based on signals and voltages output from the timing controller 120 and the power supply unit 180. The driving clock signals Clks can be generated in the form of j (j being an integer greater than or equal to 2) different phases, such as two-phase, four-phase, and eight-phase.

The shift register 131 can operate based on the signals Clks and Vst output from the level shifter 135, and output scan signals Scan[1] to Scan[m] capable of turning on or off a transistor formed on the display panel. The shift register 131 can be formed as a thin film on the display panel using a GIP method.

As illustrated in FIGS. 3 and 4, unlike the shift register 131, the level shifter 135 can be independently formed as an IC or can be included in the power supply unit 180, which is only an example and the present disclosure is not limited thereto.

As illustrated in FIGS. 5A and 5B, shift registers 131*a* and 131*b* outputting scan signals in the GIP type scan driving unit can be disposed in a non-display area NA of the display panel 150. The shift registers 131*a* and 131*b* can be disposed in the non-display area NA on left and right sides in the display panel 150 or disposed in the non-display area NA on upper and lower sides in the display panel 150. Meanwhile, in FIGS. 5A and 5B, the shift registers 131*a* and 131*b* are illustrated and described in the non-display area NA as an example. However, the present disclosure is not limited thereto.

Referring to FIG. 6, the display panel 150 can be implemented in various shapes, such as a rectangle (or a quadrangle/square) as shown in (a), a circle as shown in (b), an oval as shown in (c), and a hexagon as shown in (d). Except for the generally widely used rectangular display panel 150 illustrated in (a) of FIG. 6, the display panel 150 of each of (b) to (d) in FIG. 6 has a different shape (an uncommon shape), and thus is also referred to as a deformed display panel.

Figure 7:
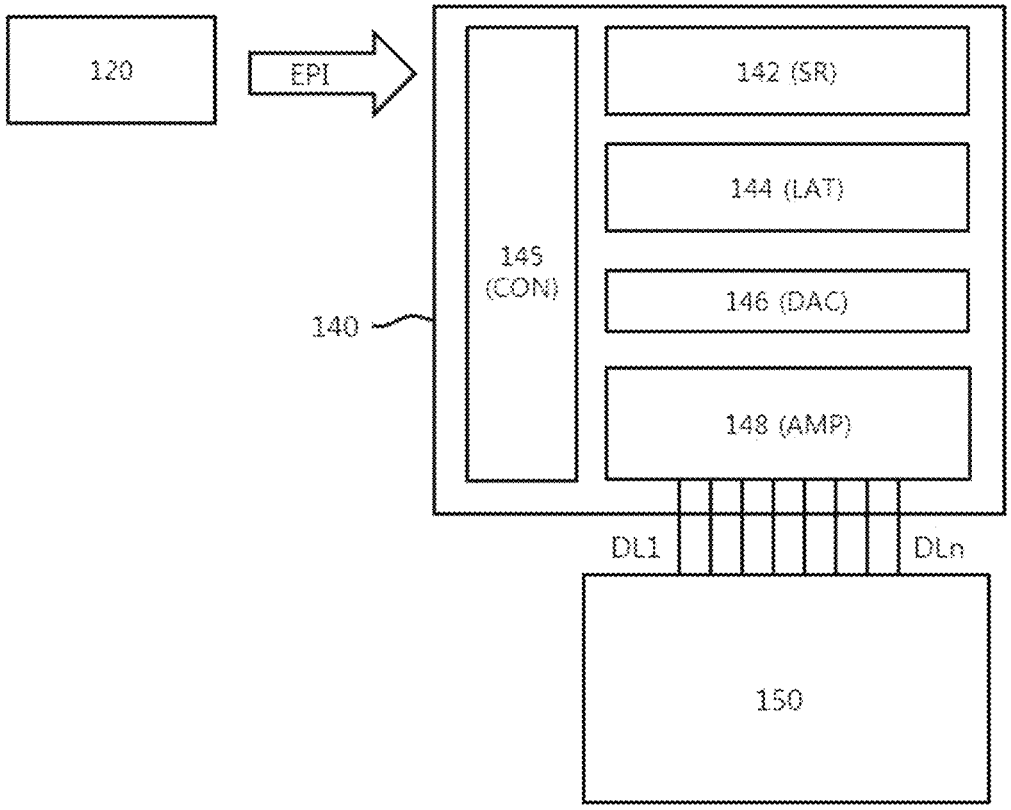
FIG. 7 is a diagram illustrating a part of the light-emitting display device according to an embodiment of the present disclosure.
Figure 8:
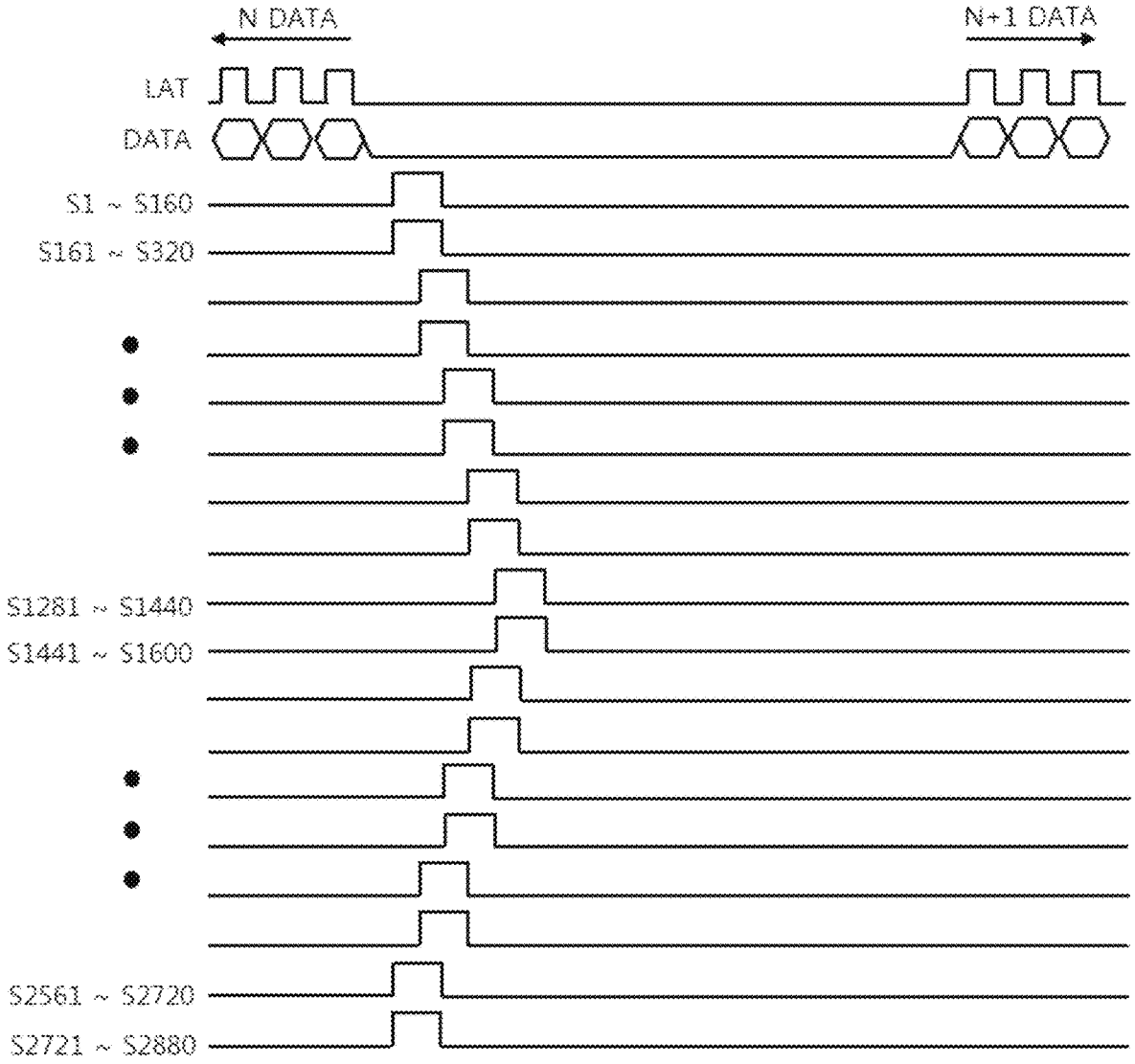
FIG. 8 is a waveform diagram illustrating an output state of a data voltage according to an embodiment of the present disclosure.
Figure 9:
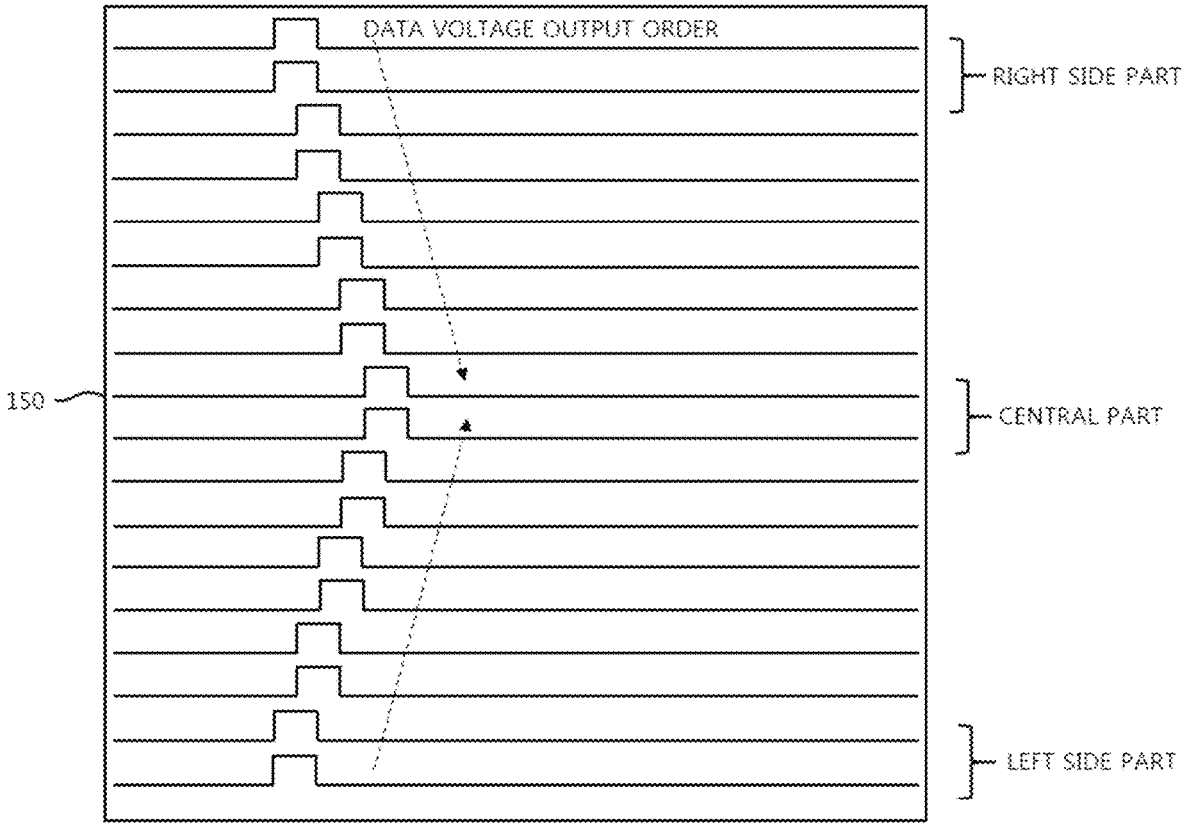
FIG. 9 is a diagram for indicating a region of the display panel to which the data voltage illustrated in FIG. 8 is applied.
Figure 10:
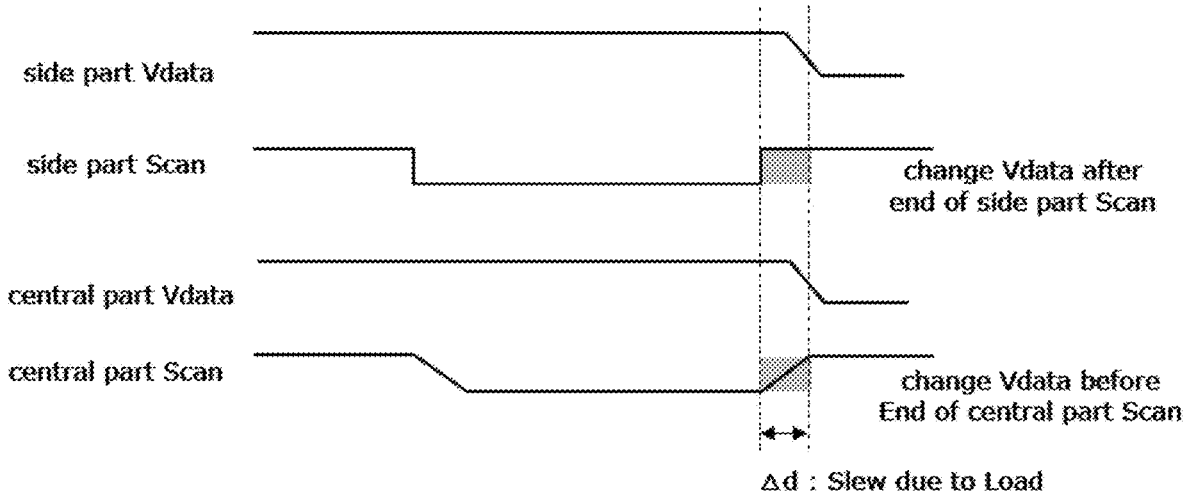
FIGS. 10 and 11 are diagrams for describing aspects before and after application of an embodiment of the present disclosure.
Figure 11:
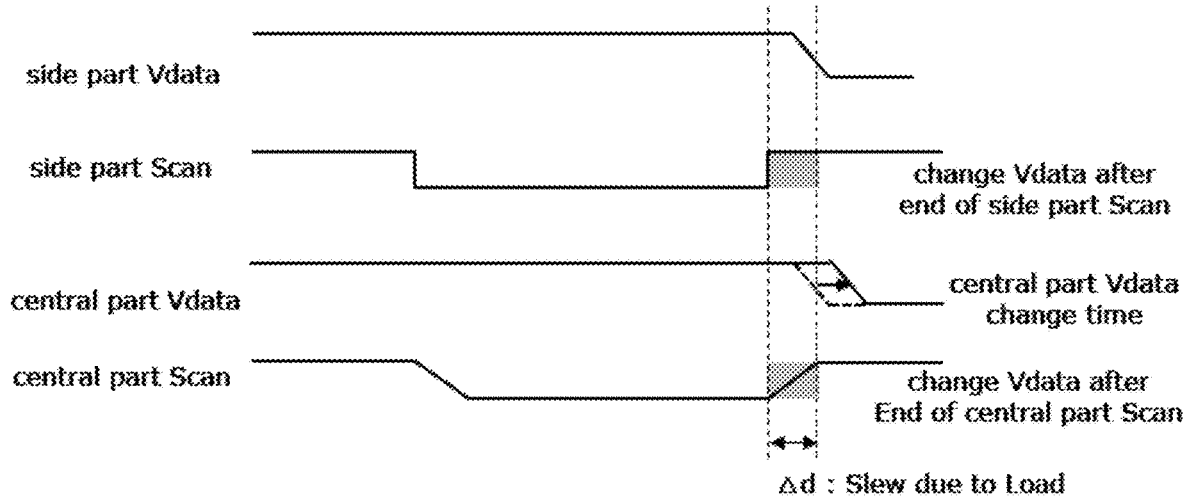

FIG. 7 is a diagram illustrating a part of the light-emitting display device according to an embodiment of the present disclosure, FIG. 8 is a waveform diagram illustrating an output state of a data voltage according to an embodiment of the present disclosure, FIG. 9 is a diagram for indicating a region of the display panel to which the data voltage illustrated in FIG. 8 is applied, and FIGS. 10 and 11 are diagrams for describing aspects before and after application of an embodiment of the present disclosure.

As illustrated in FIG. 7, according to an embodiment of the present disclosure, the timing controller 120 and the data driving unit 140 can transmit and receive various signals using a communication method. For example, the timing controller 120 and the data driving unit 140 can transmit and receive various signals using a communication method such as an Embedded Clock Point-Point Interface (EPI) based on an embedded clock method.

The data driving unit 140 can include a data controller 145 (CON), a shift register 142 (SR), a latch 144 (LAT), a digital-to-analog (Hereinafter, DA) converter 146 (DAC), an output unit 148 (AMP), etc. The data controller 145 (CON) can control the shift register 142, the latch 144, the DA converter 146, and the output unit 148 based on various signals included in a control packet and a data packet transmitted through an EPI interface (EPI).

The shift register 142 can parallelize a serial data signal supplied from the timing controller. The latch 144 can store data signals input from the outside under control of the shift register 142 line by line. The DA converter 146 can convert a data signal output from the latch 144 into a data voltage. The output unit 148 can amplify and output a data voltage output from the DA converter 146.

The shift register 142, the latch 144, the DA converter 146, and the output unit 148 can convert a data signal to be applied to the display panel 150 into a data voltage and output the data voltage under control of the data controller 145. Meanwhile, the latch 144 can include a first latch (sampling latch) that samples and outputs a digital data signal, and a second latch (holding latch) that holds and outputs a digital data signal output from the first latch. In addition, the internal blocks of the data driving unit 140 illustrated in FIG. 7 are only schematically illustrated according to an example, and the present disclosure is not limited thereto.

As illustrated in FIGS. 7 and 8, the data driving unit 140 according to the embodiment of the present disclosure can independently control latches 144 to vary the output timing of data voltages output through output channels of the output unit 148.

In more detail, even though data signals DATA input to the data driving unit 140 are stored in all latches 144 at the same time, the output timing thereof can be changed for each at least one latch 144 in response to a signal output from the data controller 145.

According to an example of FIG. 8, latches 144 connected to first to 160th output channels (S1 to S160), 161th to 320th output channels (S161 to S320), 2561th to 2720th output channels (S2561 to S2720), and 2721th to 2880th output channels (S2721 to S2880) can output data signals at the same time. In addition, the latches 144 connected thereto can output data signals first among the latches.

However, even though latches 144 connected to 1281th to 1440th output channels (S1281 to S1440) and 1441th to 1600th output channels (S1441 to S1600) output data signals at the same time, the latches 144 can output the data signals last among the latches.

Further, latches connected to output channels between the latches 144 outputting the data signals first and the latches 144 outputting the data signals last can be varied so that the output timing of outputting the data signals is gradually delayed (later).

For example, the output timing of the latches 144 connected to output channels located next to the first to 160th output channels (S1 to S160) and the 161th to 320th output channels (S161 to S320) can be defined as after the latches 144 outputting the data signals first. For example, the latches 144 connected to the output channels located next to the first to 160th output channels (S1 to S160) and the 161th to 320th output channels (S161 to S320) can have the output timing delayed by a first time compared to the latches 144 outputting the data signals first.

In addition, the output timing of latches 144 connected to output channels located before the 1281th to 1440th output channels (S1281 to S1440) can be defined as before the latches 144 outputting the data signals last. For example, the latches 144 connected to the output channels located before the 1281th to 1440th output channels (S1281 to S1440) can have the output timing advanced by a first time compared to the latches 144 outputting the data signals last.

Such an output pattern can continue to not only an Nth data signal N DATA but also an (N+1)th data signal N+1 DATA located thereafter.

As illustrated in FIGS. 8 and 9, the first to 160th output channels (S1 to S160) and the 161th to 320th output channels (S161 to S320) can supply data voltages to a right side part of the display panel 150. In addition, the 2561th to 2720th output channels (S2561 to S2720), and the 2721th to 2880th output channels (S2721 to S2880) can supply data voltages to a right side part of the display panel 150. In addition, the 1281th to 1440th output channels (S1281 to S1440) and the 1441th to 1600th output channels (S1441 to S1600) can supply data voltages to a central part of the display panel 150.

As can be seen from the correspondence of FIGS. 8 and 9, the data driving unit 140 according to the embodiment of the present disclosure illustrated in FIG. 7 can first output data voltages to be supplied to the right and left side parts of the display panel 150, and output a data voltage to be supplied to the central part of the display panel 150 last.

In addition, the output timing of the data voltage can be gradually delayed from the right side part toward the central part of the display panel 150, and the output timing of the data voltage can be gradually delayed from the right side part toward the central part of the display panel 150.

In the following, a description will be given of a reason for varying the output timing so that output of the data voltage starts from the left and right side parts of the display panel 150 and output of the data voltage finishes at the central part the display panel 150 based on the left and right side parts of the display panel 150 as described above.

As illustrated in FIG. 10, before application of the embodiment, data voltages output at the same output timing can be applied to the side parts and the central part of the display panel, which can be seen by referring to each side part data voltage (side part Vdata) applied to each side part of the display panel and a central part data voltage (central part Vdata) applied to the central part thereof.

Scan signals having different waveforms can be applied to each side part and the central part of the display panel, which can be seen by referring to each side part scan signal (side part Scan) applied to each side part of the display panel and a central part scan signal (central part Scan) applied to the central part.

The display panel can include a pixel in the form of a thin film, a shift register in the form of a GIP, and wires for applying a signal and a voltage thereto. The wires can be affected by a resistor, a parasitic capacitor, etc. as the wires are distanced from an input point at which a signal and a voltage are input. In addition, the wires can be affected by a load Δd due to a signal, a voltage, etc. In addition, the shift register in the form of the GIP can be affected by latency, etc. of a scan signal due to an increase in wires, an influence of reliability or temperature, etc.

The central part scan signal (central part Scan) applied to the central part of the display panel can be affected by at least one of the factors described above. In addition, due to this influence, the central part scan signal (central part Scan) can have a skew in which the waveform is inclined compared to each side part scan signal (side part Scan).

Since such a skew phenomenon can occur, when data voltages are applied to each side part and the central part of the display panel at the same output timing, the central part of the display panel can be affected by data voltage change before the end of the scan signal. As such, when the data voltage is changed before the end of the scan signal, a display defect (so-called color mixing) can be caused by being affected by another data voltage in the corresponding region.

As illustrated in FIG. 11, after application of the embodiment, data voltages output at different output timings can be applied to each side part and the central part of the display panel. For example, the central part data voltage (central part Vdata) applied to the central part can be output later than each side part data voltage (side part Vdata) applied to the side part of the display panel.

Scan signals having different waveforms can be applied to each side part and the central part of the display panel, which can be seen by referring to each side part scan signal (side part Scan) applied to each side part of the display panel and the central part scan signal (central part Scan) applied to the central part. In addition, as described above with reference to FIG. 10, the central part scan signal (central part Scan) applied to the central part of the display panel can be affected by the load Δd, and thus can have a skew in which the waveform is inclined compared to each side part scan signal (side part Scan) applied to each side part.

In the embodiment, in consideration of the skew phenomenon as described above, the output timing of the data voltage output to the central part rather than each side part of the display panel can be delayed. When the output timing of the data voltage output to the central part rather than each side part of the display panel is delayed, the central part data voltage can be changed after the central part scan signal ends. For example, the central part of the display panel can be safely supplied with a data voltage for displaying a current image.

In this way, when the embodiment is applied, since the data voltage is changed after the end of the scan signal, the display defect (so-called color mixing) due to being affected by other data voltages in the corresponding region may not be induced. For example, in the embodiment, the color mixing phenomenon that can be caused in a specific region such as the central part of the display panel can be relieved by changing the output timing of the data voltage for each region of the display panel.

Meanwhile, in FIG. 8 described above, note that output channels are divided into a total of 18 parts as an example in order to assist in understanding of the present disclosure. In addition, the output aspect of the data voltage can vary depending on the shape of the display panel. For example, while the display panel illustrated in FIG. 6A is used as an example, when the display panel has shapes illustrated in FIGS. 6B, 6C, and 6D, the output condition can be changed with reference to the present disclosure. For example, the output timing of the data voltage can vary according to the shape of the display panel.

Figure 12:
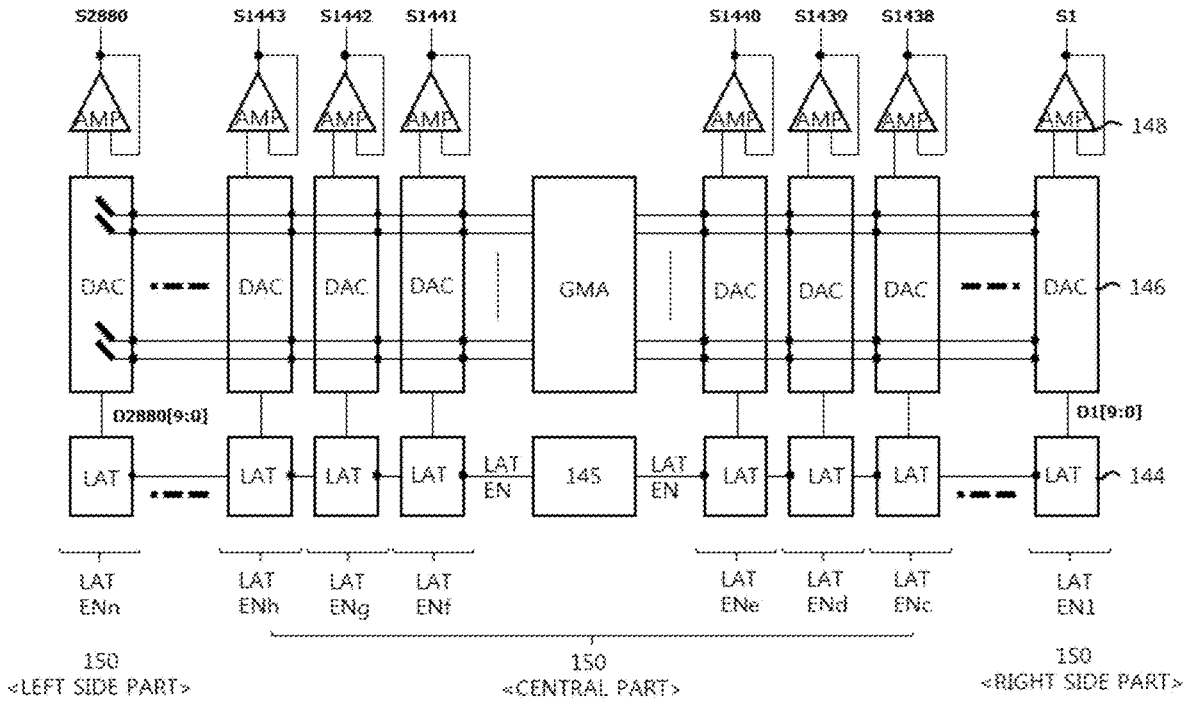
FIG. 12 is an illustrative configuration diagram of a data driving unit according to an embodiment of the present disclosure.
Figure 13:
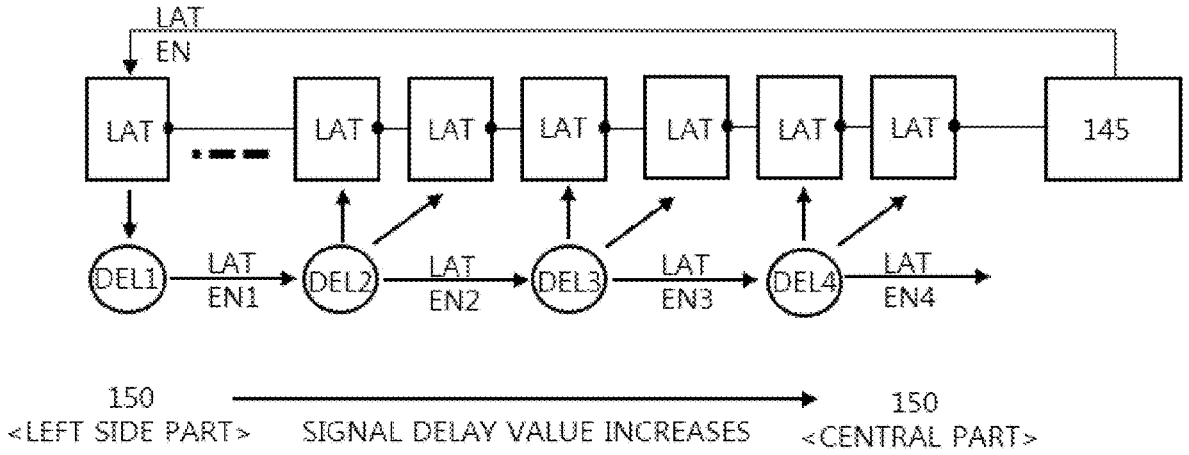
FIG. 13 is an illustrative configuration diagram illustrating a control method of a latch for outputting a data voltage as illustrated in FIG. 8.

FIG. 12 is an illustrative configuration diagram of the data driving unit according to an embodiment of the present disclosure, and FIG. 13 is an illustrative configuration diagram illustrating a control method of a latch for outputting a data voltage as illustrated in FIG. 8.

As illustrated in FIG. 12, the data driving unit according to the embodiment of the present disclosure can vary a latch enable signal LAT EN output from the data controller 145 to vary the output timing of the data voltage as described above. The latch 144 can sample or hold a data signal in response to the latch enable signal LAT EN output from the data controller 145.

A first latch enable signal LAT EN1 and a last latch enable signal LAT ENn applied to a first channel (for example, a driving channel in the left side part of the display panel) and a last channel (for example, a driving channel in the right side part of the display panel) such as a first channel S1 and a 2880th channel S2880, respectively, can be the same. For example, the first latch enable signal LAT EN1 and the Nth latch enable signal LAT ENn can be configured such that the same time for sampling or holding the data signal can be set.

On the other hand, a Cth latch enable signal LAT ENc to an Hth latch enable signal LAT ENh applied to a 1438th channel 51438 to a 1443th channel 51443 can be the same or different. For example, the Cth latch enable signal LAT ENc to the Hth latch enable signal LAT ENh can be configured such that the times for sampling or holding the data signal can be set to be the same or at least one or more thereof can be set differently.

However, the Cth latch enable signal LAT ENc to the Hth latch enable signal LAT ENh can be generated later than the first latch enable signal LAT EN1 and the Nth latch enable signal LAT ENn, or can be applied to the latches 144 with a delayed time. A reason therefor is that the 1438th channel 51438 to the 1443th channel 51443 can correspond to central channels located to correspond to the central part of the display panel 150. Meanwhile, in FIG. 12, each latch LAT latches a data signal having 10 bits [9:0] and then supplies the data signal to the DA converter 146 as an example. However, this is only an example.

As illustrated in FIG. 13, the data driving unit according to an embodiment of the present disclosure can include a delay DEL to delay the output timing of the data voltage output to the display panel 150.

In order to output the data voltage as illustrated in FIG. 8, the data controller 145 can supply an undelayed latch enable signal LAT EN to a latch LAT connected to an output channel for driving the left side part of the display panel 150. In response, the latch LAT supplied with the undelayed latch enable signal LAT EN can latch the data signal and transmit the undelayed latch enable signal LAT EN to the first delay DEL1 at the same time. In addition, the first delay DEL1 can add a first delay value to the undelayed latch enable signal LAT EN, and then transmit the signal to a second delay DEL2. In addition, the second delay DEL2 can add the first delay value and supply the delayed first latch enable signal LAT EN1 to a latch LAT assigned thereto.

The second delay DEL2 to a fourth delay DEL4, etc. can gradually increase signal delay values based on the above flow, generate a delayed second latch enable signal LAT EN2 to a delayed fourth latch enable signal LAT EN4, etc., and then supply the signals to latches LAT assigned thereto.

Based on the above flow, the sampling or holding time of the latch LAT can be controlled. In addition, accordingly, the timing when a data signal is applied to the DA converter to be converted into a data voltage (or the timing when advanced to a source decoder or DAC) and the output timing when the converted data voltage is output can be controlled as illustrated in FIG. 8. Meanwhile, in FIG. 12, a gamma unit (GMA) used to convert the data signal supplied to the DA converter 146 into a data voltage is included in the data driving unit as an example. However, this is only an example.

As described above, the present disclosure has an effect of preventing or relieving a display defect (so-called color mixing) which may be caused by latency of a scan signal, by varying the output timing of a data voltage based on independent control for each of at least one latch. In addition, since the present disclosure corrects a problem or issue which can be caused by latency of the scan signal, by the output timing of the data voltage instead of compensating for the scan signal, it is possible to increase effectiveness during high-speed driving.

It will be apparent to those skilled in the art that various modifications and variations can be made in the present disclosure without departing from the spirit or scope of the present disclosure. Thus, it is intended that the present disclosure cover the modifications and variations of this disclosure provided they come within the scope of the appended claims and their equivalents.

What is claimed is:

1. A display device comprising:

a display panel configured to display an image, and including data lines;

a scan driving circuit configured to supply a scan signal to the display panel, and a data driving circuit configured to supply a data voltage to the data lines of the display panel, wherein the data driving circuit includes a data controller configured to vary an output timing of the data voltage for each data line, wherein the data driving circuit further includes a plurality of latches, and wherein the data controller independently controls a sampling time or a holding time of each of data signals by controlling latch enable signals applied to the plurality of latches to vary the output timing of the data voltage.

2. The display device according to claim 1, wherein the data controller is configured to vary the output timing of the data voltage for each data line based on independent control for each of the plurality of latches.

3. The display device according to claim 1, wherein the plurality of latches included in the data driving circuit store the data signals at a same time, and an output timing is different for each of the plurality of latches in response to the latch enable signals.

4. The display device according to claim 3, wherein the plurality of latches included in the data driving circuit include:

a latch outputting a data signal first, and a latch outputting a data signal last, and wherein output timings of outputting the data signals are gradually varied for latches located between the latch outputting the data signal first and the latch outputting the data signal last.

5. The display device according to claim 2, wherein the data driving circuit is controlled so that the output timing of the data voltage is gradually delayed from a first side part toward a central part of the display panel, and the output timing of the data voltage is gradually delayed from a second side part toward the central part of the display panel.

6. The display device according to claim 5, wherein the first side part is a right side part, the second side part is a left side part, and the output timing of the data voltage is a same for the right side part and the left side part of the display panel.

7. The display device according to claim 2, wherein the data driving circuit outputs the data voltage first in a second side part and a first side part of the display panel, and then outputs the data voltage last in a central part of the display panel.

8. The display device according to claim 1, wherein:

the data controller includes a plurality of delays configured to delay the latch enable signals; and each of the plurality of delays adds a delay value to an undelayed latch enable signal to output a delayed latch enable signal, or adds the delay value to the delayed latch enable signal to output a further delayed latch enable signal.

9. The display device according to claim 5, wherein the scan driving circuit is disposed in a non-display area located on side portions of the display panel.

10. The display device according to claim 9, wherein the scan signal applied to the central part of the display panel ends later than the scan signal applied to the first side part and the second side part of the display panel.

11. The display device according to claim 10, wherein the output timing of the data voltage output to the central part is delayed so that the data voltage output to the central part changes after the scan signal applied to the central part of the display panel ends.

12. A data driving circuit comprising:

a plurality of latches configured to store data signals;

a plurality of digital-to-analog converters configured to convert the data signals output from the plurality of latches into data voltages;

a plurality of output circuits configured to amplify and output the data voltages output from the digital-to-analog converters through at least one channel; and a data controller configured to control the plurality of latches so that output timings of the data voltages are varied for each of the at least one channel, and wherein the data controller independently controls a sampling time or a holding time of each of the data signals by controlling latch enable signals applied to the plurality of latches to vary the output timings of the data voltages.

13. The data driving circuit according to claim 12, wherein the plurality of latches store the data signals at a same time, and an output timing is different.

14. The data driving circuit according to claim 12, wherein the plurality of latches include:

a latch outputting a data signal first, and a latch outputting a data signal last, and wherein output timings of outputting the data signals are gradually varied for latches located therebetween among the plurality of latches.

* * * * *